US005877583A

United States Patent [19]

Meglio et al.

[11] Patent Number: 5,877,583

[45] Date of Patent: Mar. 2, 1999

[54] SEAL PLUG FOR A CRT COOLING SYSTEM

[75] Inventors: Charles A. Meglio, Greensburg, Pa.; Hiroyuki Takezawa, Kanagawa, Japan

[73] Assignees: Sony Corporation, Tokyo, Japan; Sony Electronics Inc., Park Ridge, N.J.

[21] Appl. No.: 982,607

[22] Filed: Dec. 2, 1997

[51] Int. Cl.[6] ..... H01J 7/26

[52] U.S. Cl. ..... 313/35; 313/36; 313/45; 313/477 R

[58] Field of Search ..... 313/11, 12, 22, 313/35, 36, 44, 45, 477 R; 348/779, 781

[56] References Cited

U.S. PATENT DOCUMENTS

| | | | |
|---|---|---|---|
| 4,740,727 | 4/1988 | Inaida et al. | 313/36 |
| 4,780,640 | 10/1988 | Hasegawa | 313/36 |
| 5,617,259 | 4/1997 | Inoue | 359/820 |

FOREIGN PATENT DOCUMENTS 7-11399 3/1995 Japan .

*Primary Examiner*—Vip Patel
*Attorney, Agent, or Firm*—Pasquale Musacchio; Jerry A. Miller

[57] ABSTRACT

Apparatus for sealing a chamber having a liquid coolant used for dissipating heat generated by a CRT. The apparatus includes a chassis for housing the CRT, wherein the chassis includes a tapered fill port having an inner wall. In particular, the fill pole is in fluid communication with the chamber and is used for introducing liquid coolant into the chamber. A sealing element is then positioned in the fill port. The sealing element is fabricated from a material having resilient properties and is sized larger than the fill port such that a press fit is formed wherein said sealing element is urged against said inner wall to form a seal.

14 Claims, 5 Drawing Sheets

SEAL PLUG FOR A CRT COOLING SYSTEM

FIELD OF THE INVENTION

The present invention relates to cooling systems for cathode ray tube (CRT) devices, and more particularly, to a technique for sealing a cooling system which is used to dissipate heat generated by the CRT.

BACKGROUND OF THE INVENTION

Cathode ray tubes (CRTs) are frequently used in conjunction with a projection lens to provide an image. In normal use however, CRTs generate an amount of heat which is sufficient to undesirably degrade picture quality. In order to dissipate this heat, many CRTs utilize a cooling system having a liquid coolant which serves as a heat sink. In addition, the liquid coolant may be clear and colorless so as to serve as a liquid lens. Referring to FIG. 1, a CRT 10 and projection lens 12 are shown positioned within a chassis 14. The chassis 14 includes partitions 16 which together with a back surface 18 of the projection lens 12 form a chamber 20 for holding a liquid coolant 22 for dissipating heat. Referring to FIG. 2, an enlarged portion of the chassis 14 is shown. The chassis 14 further includes a fill hole 24 which is in fluid communication with the chamber 20. In use, the liquid coolant 22 is introduced into the fill hole 24 in order to fill the chamber 20. A fastener 26 is then inserted into the fill hole 24. The fastener 26 includes fastener threads 30 which are threaded with fill hole threads 32 to secure the fastener 26. The fastener 26 includes a sealing element such as an o-ring 28 which is compressed between the fastener 26 and a shoulder portion of the chassis 14 upon securing of the fastener 26 in the fill hole 24. This forms a seal which serves to maintain the liquid coolant 22 within the chamber 20.

However, such sealing arrangements have disadvantages. A disadvantage is that paint which may be present on the fastener threads 30 (due to paint overspray, etc.) may be removed due to contact with the fill hole threads 32. This generates paint particulates which ultimately contaminate the liquid coolant 22 and thus degrade picture quality. In addition, the liquid coolant 22 may be further contaminated by metal particulates which are generated due to metal to metal contact between the fastener 30 and fill hole 32 threads. Moreover, still further particulates may be generated due to cross threading of the fastener 30 and fill hole 32 threads, thus resulting in broken thread fragments which also contaminate the liquid coolant 22 and thus also degrade picture quality.

Another sealing arrangement is described in Japanese Utility Model No. 7-11399. This document discloses a CRT apparatus having a flexible, tube shaped sealing element which is positioned within a fill port used for introducing a liquid coolant. A shaft portion of an elongated fastener is positioned through the tube. A washer is located between an end of the tube and the head of the fastener. In use, the fastener is threaded into a portion of the chassis, thus urging the washer against the tube to compress the tube axially and expand the tube radially against inner portions of the fill port to form a seal. However, fabrication of the threads and assembly of the components is relatively time consuming and thus costly.

SUMMARY OF THE INVENTION

Apparatus for sealing a chamber having a liquid coolant used for dissipating heat generated by a CRT. The apparatus includes a chassis for housing the CRT, wherein the chassis includes a tapered fill port having an inner wall. In particular, the fill port is in fluid communication with the chamber and is used for introducing liquid coolant into the chamber. A sealing element is then positioned in the fill port. The sealing element is fabricated from a material having resilient properties and is sized larger than the fill port such that a press fit is formed wherein said sealing element is urged against said inner wall to form a seal.

The features of the invention believed to be novel are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION

Figure 1:
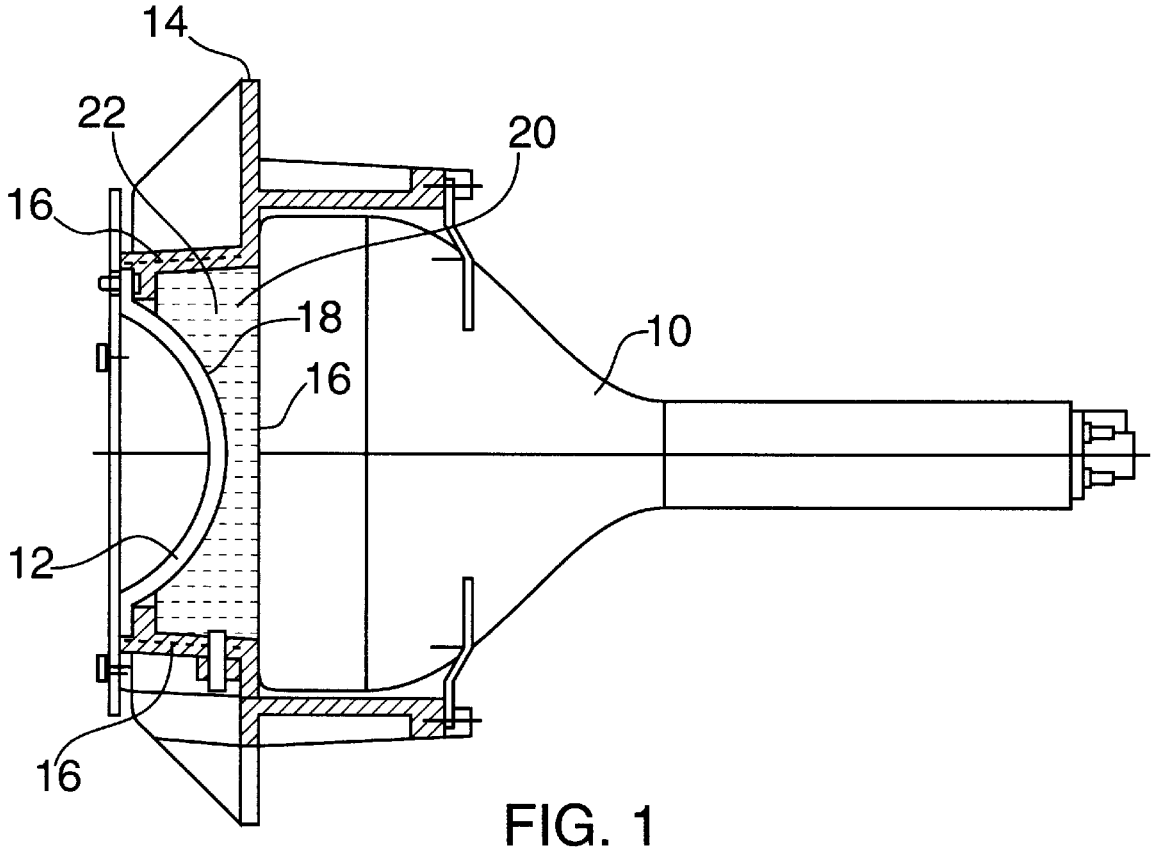
FIG. 1 is a view of a conventional chassis for housing a cathode ray tube.
Figure 2:
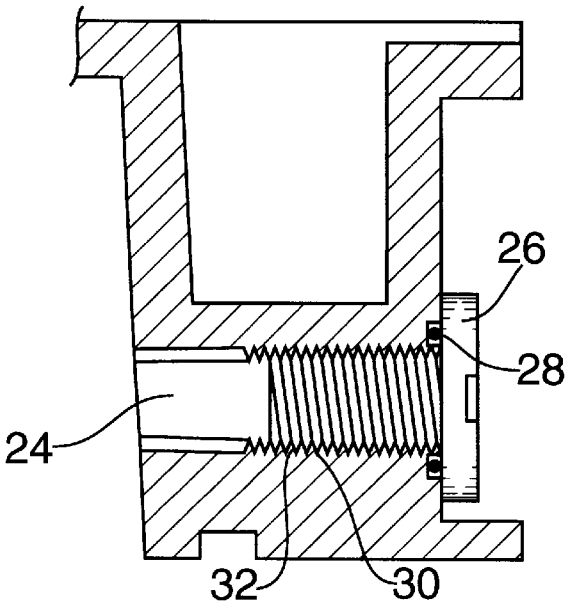
FIG. 2 PRIOR ART
FIG. 2 is a cross sectional view of a conventional sealing arrangement for a CRT cooling system.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same similar or corresponding parts in FIGS. 1–7.

Figure 3:
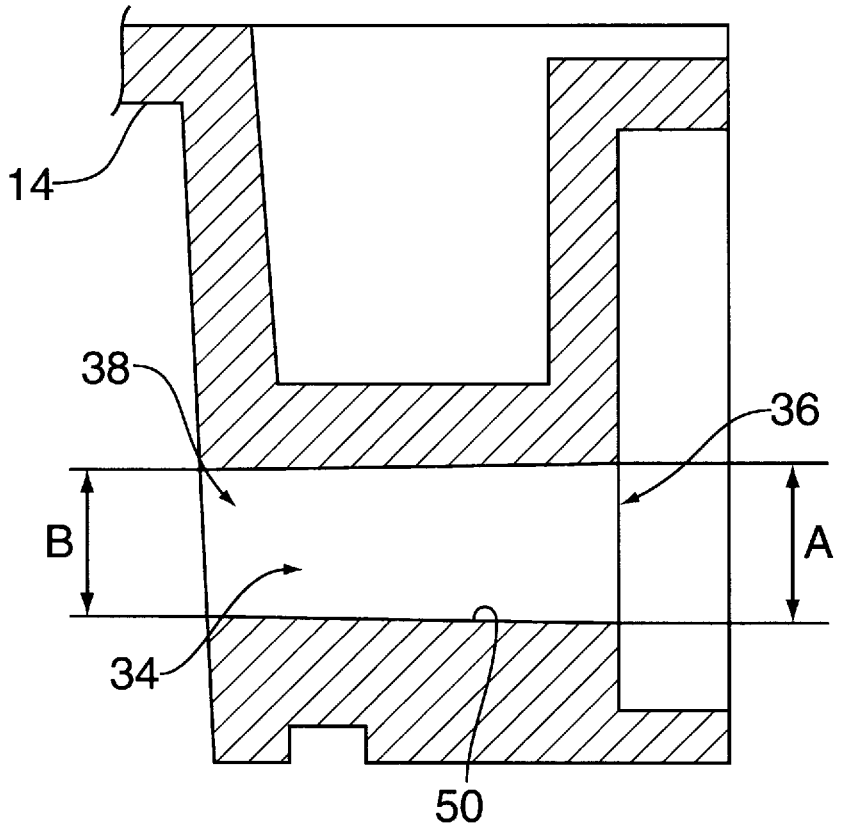
FIG. 3 is a cross sectional view of a fill port for a CRT cooling system in accordance with the present invention.

Referring to FIG. 3, a portion of the chassis 14 having a fill port 34 in accordance with the present invention is shown. The fill port 34 includes an inlet end 36 having an inlet diameter A and an outlet end 38 having an outlet diameter B which is smaller than the inlet diameter A to form an inner wall 50 having a tapered configuration. The liquid coolant 22 is introduced into the inlet end 36, flows out the outlet end 38 and ultimately into the chamber 20.

Figure 4:
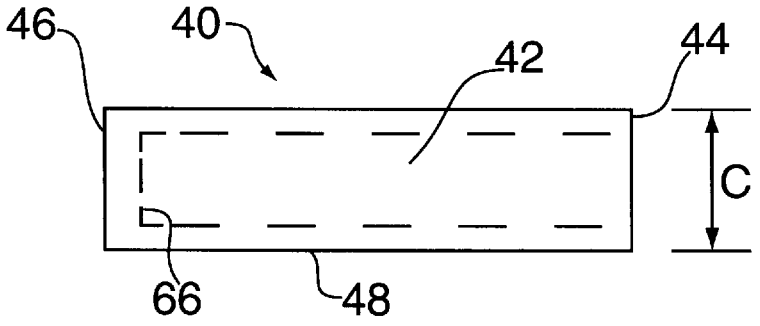
FIG. 4 is a view of a first embodiment of a seal plug in accordance with the present invention.

Referring to FIG. 4, a seal plug 40 in accordance with the present invention is shown. The seal plug 40 is cylindrically shaped and has a plug diameter C which is greater than either the inlet 36 or outlet 38 diameters. The seal plug 40 includes an outer surface 48 and is fabricated from a resilient material such as silicone or rubber and may be an elastomer. The seal plug 40 includes a cavity 42 (shown as a dotted line) which extends from a first end 44 of the seal plug 40 and terminates at a cavity end surface 66 which is before a second end 46 of the seal plug 40.

Figure 5:
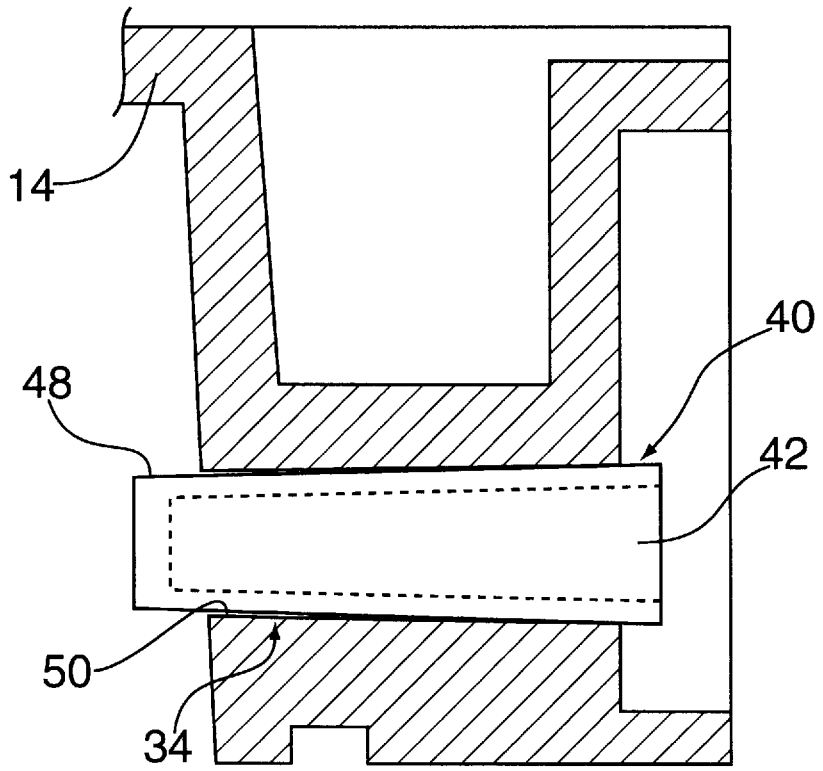
FIG. 5 is a view of the seal plug shown in FIG. 4 press fit into the fill port shown in FIG. 3.

Referring to FIG. 5, the seal plug 40 is inserted into the fill port 34 to form a press fit which radially compresses the seal plug 40. The resiliency of the seal plug 40 then urges the outer surface 48 against the inner wall 50 of the fill port 34 to form a seal between the outer surface 48 and the inner wall 50. Further, this results in the seal plug 40 taking on a tapered shape which corresponds to the tapered shape of the fill port 34. In this regard, it is noted that the cavity 42 serves to assist in compression of the seal plug 40.

Figure 6:
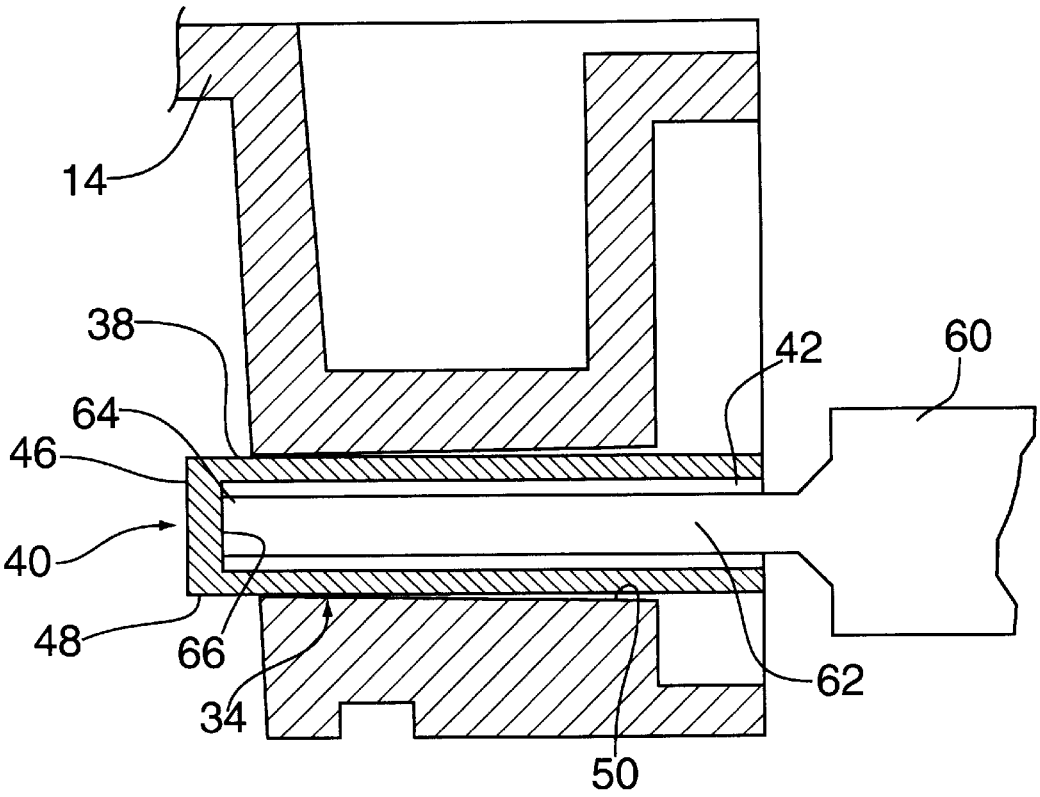
FIG. 6 is view of the seal plug being inserted into the fill port by a mandrel.
Figure 7:
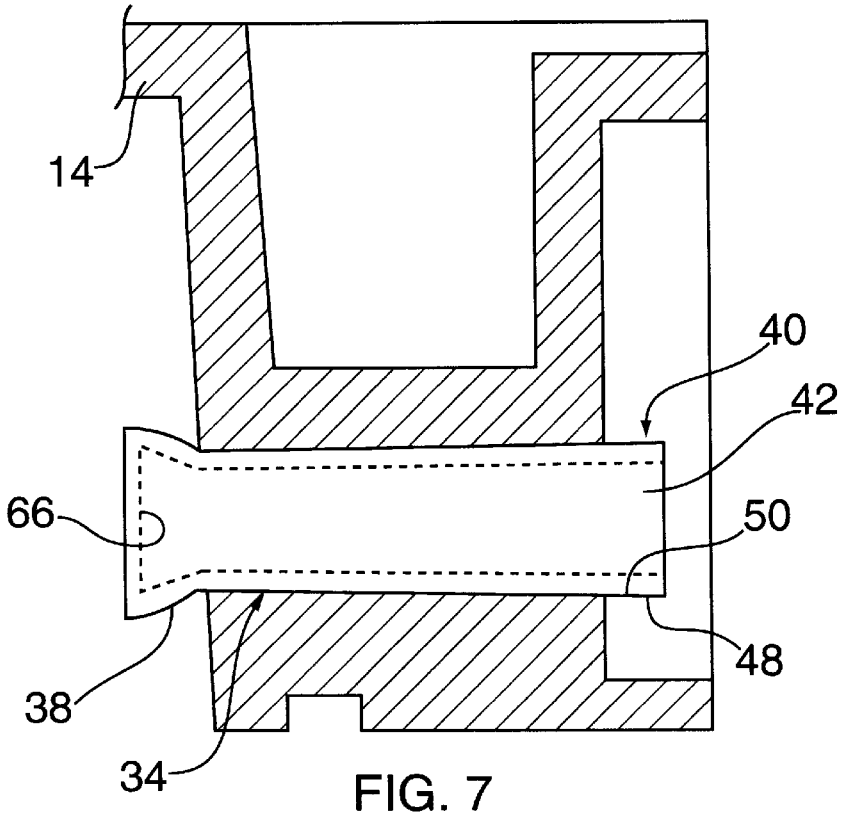
FIG. 7 is a view of the seal plug having a pinched configuration after installation into the fill port by the mandrel.

Referring to FIG. 6, a technique for installing the seal plug 40 by utilizing a pin or mandrel 60 having a projecting portion 62 is shown. In use, the seal plug 40 is positioned within the fill port 34. The projecting portion 62 is then inserted into the cavity 42 such that a mandrel end 64 of the projecting portion 62 abuts against the cavity end surface 66. The mandrel end 64 is then thrust against the cavity end surface 66, which causes the seal plug 40 to contact the inner wall 50. This causes the seal plug 40 to elongate, thus reducing the diameter of the seal plug 40 to enable positioning of the second end 46 of the seal plug 40 through the outlet end 38 of the fill port 34. The projecting portion 62 is then removed and the resiliency of the seal plug 40 then urges the outer surface 48 against the inner wall 50 to form a seal between the outer surface 48 and the inner wall 50 as previously described. Referring to FIG. 7, this causes portions of the seal plug 40 which extend from the outlet end 38 to assume a diameter which is greater than outlet diameter B (FIG. 3), thus resulting in a pinched configuration for the seal plug 40.

Figure 8:
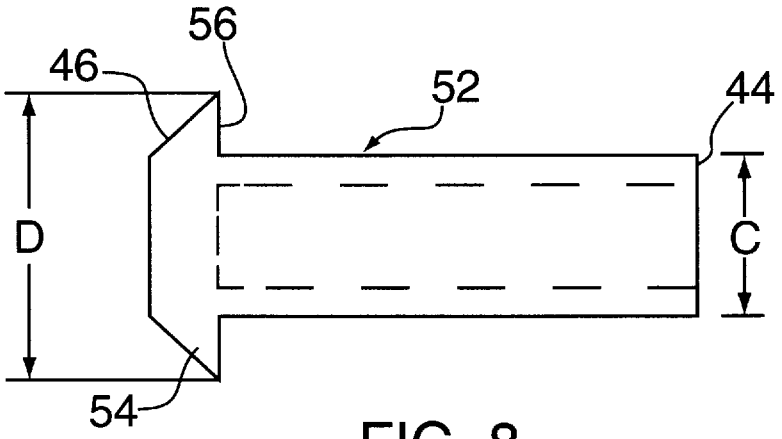
FIG. 8 is a view of a second embodiment of a seal plug in accordance with the present invention.
Figure 9:
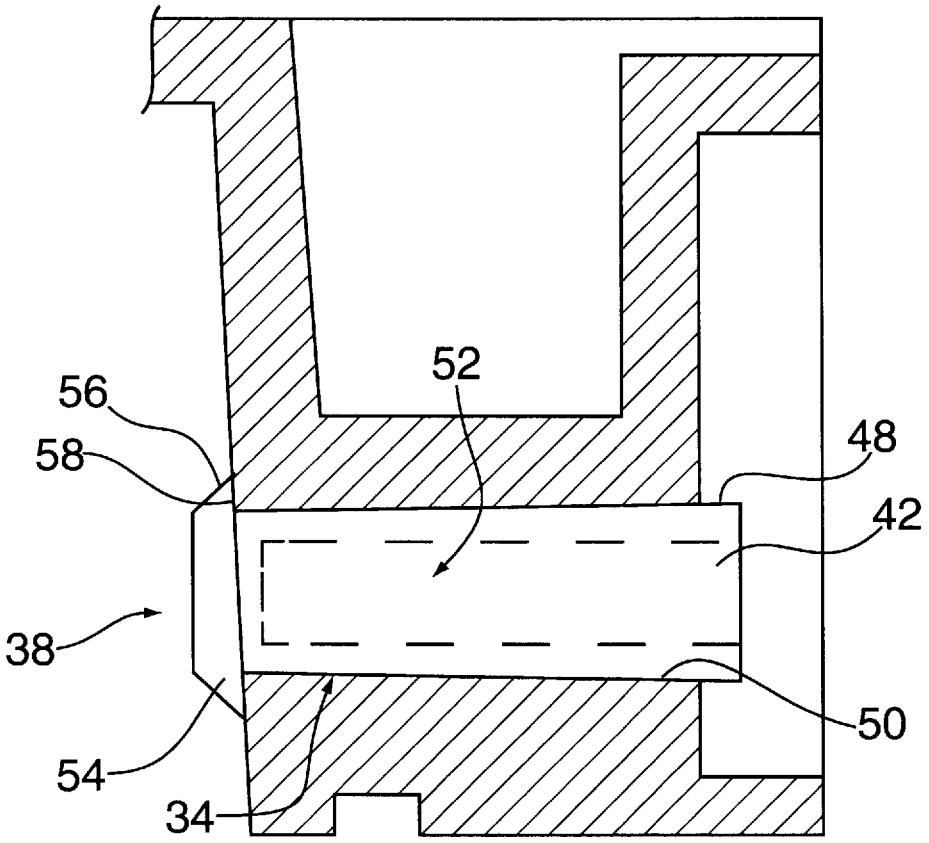
FIG. 9 is a view of the seal plug shown in FIG. 6 press fit into the fill port shown in FIG. 3.

Referring to FIG. 8, an alternate embodiment for a seal plug 52 is shown. In this embodiment, the second end 46 includes an endcap portion 54 having an outwardly extending flange 56 having a flange diameter D which is greater than the plug diameter C. Upon insertion of the seal plug 52 into the fill port 34, the flange 56 abuts against a shoulder portion 58 of the outlet end 38 (FIG. 9) and thus serves to inhibit removal of the seal plug 52 from fill port 34.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations are far within the scope of the appended claims.

What is claimed is:

1. A liquid cooling CRT assembly comprising:

a chassis attached to said CRT, said chassis including a tapered fill port having inlet and outlet openings for introduction of a liquid coolant into a chamber, said inlet opening having greater diameter than said outlet opening, and an inner wall, wherein said fill port is in fluid communication with said chamber, and a sealing element having a cavity that extends partially therethrough positioned in said fill port, said sealing element having resilient properties and being sized larger than said fill port wherein upon positioning said sealing element in said fill port a press fit is formed wherein said sealing element is pressed against said inner wall to form a seal therebetween, and an end cap formed on an end of said sealing element, said end cap having a flange which abuts against a portion of said chassis adjacent said fill port to inhibit removal of said seal plug.

2. The apparatus according to claim 1 wherein said sealing element is cylindrically shaped.

3. The apparatus according to claim 1 wherein said sealing element is fabricated from an elastomer.

4. The apparatus according to claim 1 wherein said sealing element is fabricated from silicone.

5. The apparatus according to claim 1 wherein said sealing element is fabricated from rubber.

6. A liquid cooling CRT assembly comprising:

a chassis attached to said CRT, said chassis including a tapered fill port having inlet and outlet openings for introduction of a liquid coolant into a chamber, said inlet opening having greater diameter than said outlet opening, and an inner wall, wherein said fill port is in fluid communication with said chamber, and a cylindrical sealing element having a cavity that extends partially therethrough positioned in said fill port, said sealing element having resilient properties and being sized larger than said fill port wherein upon positioning said sealing element in said fill port a press fit is formed wherein said sealing element is pressed against said inner wall to form a seal therebetween, and an end cap formed on an end of said sealing element, said end cap having a flange which abuts against a portion of said chassis adjacent said fill port to inhibit removal of said seal plug.

7. The apparatus according to claim 6 wherein said sealing element is fabricated from an elastomer.

8. The apparatus according to claim 6 wherein said sealing element is fabricated from silicone.

9. The apparatus according to claim 6 wherein said sealing element is fabricated from rubber.

10. A method for sealing a chamber having a liquid coolant used for dissipating heat generated by a CRT, comprising:

providing a chassis attached to said CRT, said chassis including a tapered fill port having inlet and outlet openings for introduction of a liquid coolant into a chamber, said inlet opening having greater diameter than said outlet opening, and an inner wall, wherein said fill port is in fluid communication with said chamber, and providing a sealing element having a cavity that extends partially therethrough, said sealing element having resilient properties and being sized larger than said fill port, an end cap formed on an end of said sealing element, said end cap having a flange, and positioning said sealing element in said fill port to form a press fit wherein said sealing element is pressed against said inner wall to form a seal therebetween.

11. The apparatus according to claim 10 wherein said sealing element is cylindrically shaped.

12. The apparatus according to claim 10 wherein said sealing element is fabricated from an elastomer.

13. The apparatus according to claim 10 wherein said sealing element is fabricated from silicone.

14. The apparatus according to claim 10 wherein said sealing element is fabricated from rubber.

* * * * *